US006739313B2

(12) United States Patent
Watanabe

(10) Patent No.: US 6,739,313 B2
(45) Date of Patent: May 25, 2004

(54) AIR INDUCTION SYSTEM FOR MULTI-CYLINDER ENGINE

(75) Inventor: Hitoshi Watanabe, Shizuoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 09/976,820

(22) Filed: Oct. 11, 2001

(65) Prior Publication Data

US 2002/0112696 A1 Aug. 22, 2002

Related U.S. Application Data

(60) Provisional application No. 60/322,193, filed on Sep. 13, 2001.

(30) Foreign Application Priority Data

Oct. 11, 2000 (JP) ..... 2000-311245

(51) Int. Cl.[7] ..... F02M 35/10
(52) U.S. Cl. ..... 123/339.23; 123/184.24
(58) Field of Search ..... 123/184.24, 184.34, 123/339.23, 339.1

(56) References Cited

U.S. PATENT DOCUMENTS

| | | | |
|---|---|---|---|
| 4,326,600 | A | 4/1982 | Okazaki et al. |
| 4,380,516 | A | 4/1983 | Matsuzaka |
| 4,488,519 | A | 12/1984 | Kishida |
| 4,512,152 | A | 4/1985 | Asaba |
| 4,512,311 | A | 4/1985 | Sugiyama |
| 4,570,744 | A | 2/1986 | Hoshiba |
| 4,852,686 | A | 8/1989 | Sougawa |
| 4,887,692 | A | 12/1989 | Outani et al. |
| 4,924,834 | A | 5/1990 | Bonfiglioli et al. |
| 5,063,885 | A | 11/1991 | Yoshioka |
| 5,074,257 | A | 12/1991 | Amano et al. |
| 5,133,307 | A | 7/1992 | Kurihara |
| 5,146,888 | A | 9/1992 | Sawamoto |
| 5,203,292 | A | 4/1993 | Motose |
| 5,353,758 | A | 10/1994 | Masuda et al. |

(List continued on next page.)

FOREIGN PATENT DOCUMENTS

| | | |
|---|---|---|
| GB | 2321085 | 7/1998 |
| JP | 61-93228 | 5/1986 |
| JP | 3-121266 | 5/1991 |
| JP | 11-34985 | 2/1999 |
| JP | 2000-130262 | 5/2000 |

OTHER PUBLICATIONS

Co–pending patent application No. 09/422,305, filed Oct. 21, 1999, in the name of Yoshikazu Nakayasu, entitled Idle Speed Control for Engine and assigned to Sanshin Kogyo Kabushiki Kaisha.

(List continued on next page.)

*Primary Examiner*—Marguerite McMahon
(74) *Attorney, Agent, or Firm*—Knobbe, Martens, Olson & Bear, LLP

(57) ABSTRACT

An air induction system is arranged to introduce air into a plurality of combustion chambers. The air induction system includes intake passages through which the air flows to the combustion chambers. Throttle valves are arranged to regulate an amount of the air flowing through the intake passages. Auxiliary runners communicate with the intake passages at a location positioned downstream of the throttle valves. The respective runners are unified with each other to form a common chamber. A single conduit has an end communicating with the common chamber and another end communicating with a location that generally is at atmospheric pressure. The air flowing through the conduit, the common chamber and the auxiliary runners also is supplied to the combustion chambers. The common chamber can be positioned next to the intake passages. A control valve can be provided at a location along the single conduit.

46 Claims, 4 Drawing Sheets

U.S. PATENT DOCUMENTS

| | | | | |
|---|---|---|---|---|
| 5,476,402 | A | 12/1995 | Nakai et al. | |
| 5,488,939 | A | 2/1996 | Nakai et al. | |
| 5,513,606 | A | 5/1996 | Shibata | |
| 5,649,512 | A | 7/1997 | Flanery, Jr. et al. | |
| 5,743,228 | A | 4/1998 | Takahashi | |
| 5,769,060 | A | 6/1998 | Matsumoto | |
| 5,829,402 | A | 11/1998 | Takahashi et al. | |
| 5,855,193 | A | 1/1999 | Takahashi | |
| 5,873,332 | A | 2/1999 | Taue et al. | |
| 5,873,347 | A | 2/1999 | Kato et al. | |
| 5,899,197 | A | 5/1999 | Watanabe et al. | |
| 5,915,363 | A | 6/1999 | Iwata et al. | |
| 5,924,409 | A | 7/1999 | Kato | |
| 5,941,205 | A | 8/1999 | Hiraoka et al. | |
| 5,975,032 | A | 11/1999 | Iwata | |
| 5,983,878 | A | 11/1999 | Nonaka et al. | |
| 6,015,319 | A | 1/2000 | Tanaka | |
| 6,019,083 | A | 2/2000 | Isogawa | |
| 6,041,754 | A | 3/2000 | Mori et al. | |
| 6,062,927 | A | 5/2000 | Hiraoka et al. | |
| 6,125,820 | A | 10/2000 | Hiraoka | |
| 6,481,411 | B1 * | 11/2002 | Katayama | 123/339.23 |

OTHER PUBLICATIONS

Co–pending patent application: Ser. No. 09/497,570, filed Feb. 3, 2000, entitled Fuel Injection for Engine, in the name of Isao Kanno, and assigned to Sanshin Kogyo Kabushiki Kaisha.

Co–pending patent application: Ser. No. 09/494,395, filed Jan. 31, 2000, entitled Engine Idle Control System, in the name of Isao Kanno, Yoshikazu Nakayasu and assigned to Sanshin Kogyo Kabushiki Kaisha.

Co–pending patent application: Ser. No. 09/626,868, filed Jul. 27, 2000, entitled Engine Control System, in the name of Isao Kanno, and assigned to Sanshin Kogyo Kabushiki Kaisha.

Co–pending patent application No. 09/664,514, filed Sep. 18, 2000, in the name of Hitoshi Watanabe, entitled Four–Cycle Engine and assigned to Sanshin Kogyo Kabushiki Kaisha.

Co–pending patent application No. 09/688,511, Oct. 16, 2000, in the name of Isogawa et al., entitled Engine Throttle Valve Linkage and assigned to Sanshin Kogyo Kabushiki Kaisha.

Co–pending patent application: Ser. No. 09/694,080, filed Oct. 19, 2000, entitled Electrical System for Marine Outboard Drive, in the name of Yasuo Suganuma, and assigned to Sanshin Kogyo Kabushiki Kaisha.

Co–pending patent application No. 09/742,777, filed Dec. 20, 2000, in the name of Watanabe et al., entitled Component Mounting Arrangement for Engine and assigned to Sanshin Kogyo Kabushiki Kaisha.

Co–pending patent application: Ser. No. 09/878,323, filed Jun. 11, 2001, entitled Four–Cycle Engine for Marine Drive, in the name of Isao Kanno, and assigned to Sanshin Kogyo Kabushiki Kaisha.

Co–pending patent application No. 09/906570, filed Jul. 16, 2001, in the name of Osakabe et al., entitled Air Induction System for Engine and assigned to Sanshin Kogyo Kabushiki Kaisha.

Co–pending patent application No. __, filed Sep. 26, 2001, in the name of Watanabe et al., entitled Air Induction System for Engine and assigned to Sanshin Kogyo Kabushiki Kaisha.

* cited by examiner

AIR INDUCTION SYSTEM FOR MULTI-CYLINDER ENGINE

PRIORITY INFORMATION

This application is based on and claims priority to Japanese Patent Application No. 2000-311245, filed Oct. 11, 2000, the entire contents of which is hereby expressly incorporated by reference. This application also claims priority under 35 U.S.C. §119(e) of copending U.S. Provisional Patent Application No. 60/322,193, which was filed on Sep. 13, 2001 and was entitled Air Induction System for Multi-Cylinder Engine, which is hereby incorporated by reference in its entirety.

BACKGROUND OF THE INVENTION

1. Field of the Invention

The present invention relates generally to an air induction system for a multi-cylinder engine and, more particularly, to an improved air induction system for a multi-cylinder engine that includes an auxiliary air supply arrangement.

2. Description of Related Art

Multi-cylinder engines can have air induction systems that include multiple air intake passages through which air can be introduced into a set combustion chambers. Each intake passage is provided with a throttle valve that regulates an amount of air provided to the engine (i.e., controls the airflow rate) and is operable with an appropriate throttle linkage. The induction system thus can supply a desired amount of air to the combustion chambers based upon the throttle opening degree, which corresponds to operator demand on engine output.

In most engine technologies, an idle condition exists when the engine maintains a certain preset engine speed with substantially no applied engine load. Typically, the throttle valves are held in an almost closed position during idling. In some engine configurations, auxiliary intake passages are provided to bypass the throttle valves so that a certain preset amount of air can be supplied to the combustion chambers even though the throttle valves are substantially closed during idling. U.S. Pat. No. 6,015,319 discloses an improved air induction system that includes such auxiliary intake passages. The auxiliary intake passages can be used for other purposes, as well. For instance, during sudden deceleration, the throttle valves generally would be abruptly closed and such an abrupt closure may invite engine stall. An additional amount of air can be supplied through the auxiliary passages to reduce the likelihood of engine stall. In some situations, the engine also may need supplemental air during rapid acceleration. This supplemental air can also be supplied through the auxiliary passages.

Typically, each auxiliary passage has a relatively small diameter. The restricted diameter may result in a delayed flow of the supplemental air due to internal flow resistance. In other words, the desired amount of supplemental air may not be timely supplied. Nevertheless, broadening the passages is contrary to the desire to minimize engine component sizes to reduce overall engine compartment size. JP 2000-130262 discloses a common chamber that is defined by unifying the auxiliary intake passages. The common chamber can improve the situation to a certain extent. However, the delayed air flow still occurs to an unacceptable degree.

A need therefore exists for an improved air induction system for a multi-cylinder engine that can supply supplemental air through auxiliary passages without significantly delaying the air flow when the need for the air arises.

The auxiliary intake passages can also include a control device that controls an amount of the air passing through the auxiliary passages. Typically, the device includes a control valve that is controlled by an electronic control unit (ECU). JP 2000-130262 also discloses a control device disposed on a member that at least partially defines the common chamber. As disclosed therein, the unitary mechanism that includes the control device and the common chamber is mounted in a location on the engine that can accommodate the unitary mechanism. The space, however, generally is relatively far from the primary intake passages. Thus, the length of the auxiliary passages is increased and the flow resistance, therefore, also increases.

Another need thus exists for an improved air induction system for a multi-cylinder engine that can provide an appropriate arrangement in which flow resistance of air that passes through the auxiliary intake passages does not substantially increase due to the provision of a control device that controls an amount of air passing though the auxiliary passages.

SUMMARY OF THE INVENTION

In accordance with one aspect of the present invention, an internal combustion engine comprises an engine body. A plurality of moveable members are moveable relative to the engine body. The engine body and the moveable members together define a plurality of combustion chambers. An air induction system is arranged to introduce air into the combustion chambers. The air induction system includes first intake passages through which the air at least in part flows to the combustion chambers. At least one valve is arranged to regulate an amount of the air flowing through the first intake passages. Second intake passages are provided through which the air at least in part flows to the combustion chambers. Each one of the second intake passages communicates with each one of the first intake passages at a location positioned downstream of the first valve. The second intake passages are unified with each other to form a unified portion. The unified portion at least in part defines a common chamber and an air inlet. The common chamber is positioned closer to the location communicating with the first intake passages than the air inlet.

In accordance with another aspect of the present invention, an internal combustion engine comprises an engine body. A plurality of moveable members are moveable relative to the engine body. The engine body and the moveable members together define a plurality of combustion chambers. An air induction system is arranged to introduce air into the combustion chambers. The air induction system includes primary passages through which first part of the air flows to the combustion chambers. At least one valve is arranged to regulate an amount of the air flowing through the primary passages. First auxiliary passages each communicates with each one of the primary passages at a location positioned downstream of the valve. The first auxiliary passages are unified with each other to form a common chamber. A second auxiliary passage has a first end communicating with the common chamber and a second end communicating with a location in the atmosphere. Second part of the air flows to the combustion chambers through the first and second auxiliary passages and the common chamber. The common chamber is positioned next to the primary passages.

In accordance with a further aspect of the present invention, an internal combustion engine comprises an engine body. A plurality of moveable members are moveable relative to the engine body. The engine body and the moveable members together define a plurality of combustion chambers. An air induction system is arranged to introduce air into the combustion chambers. The air induction system includes intake passages through which first part of the air flows to the combustion chambers. At least one first valve is arranged to regulate an amount of the first part of the air. Multiple secondary passages each communicates with each one of the intake passages at a location positioned downstream of the first valve. The multiple secondary passages are unified with each other to form a common chamber. A single secondary passage has a first end communicating with the common chamber and a second end communicating with a location in the atmosphere. Second part of the air flows to the combustion chambers through the single and multiple secondary passages and the common chamber. A second valve is arranged to control an amount of the second part of the air. The second valve is positioned in the single secondary passage apart from the common chamber.

BRIEF DESCRIPTION OF THE DRAWINGS

These and other features, aspects and advantages of the present invention will now be described with reference to the drawings of a preferred embodiment, which embodiments are intended to illustrate and not to limit the present invention. The drawings comprise four figures.

DETAILED DESCRIPTION OF THE PREFERRED EMBODIMENTS OF THE INVENTION

Figure 1:
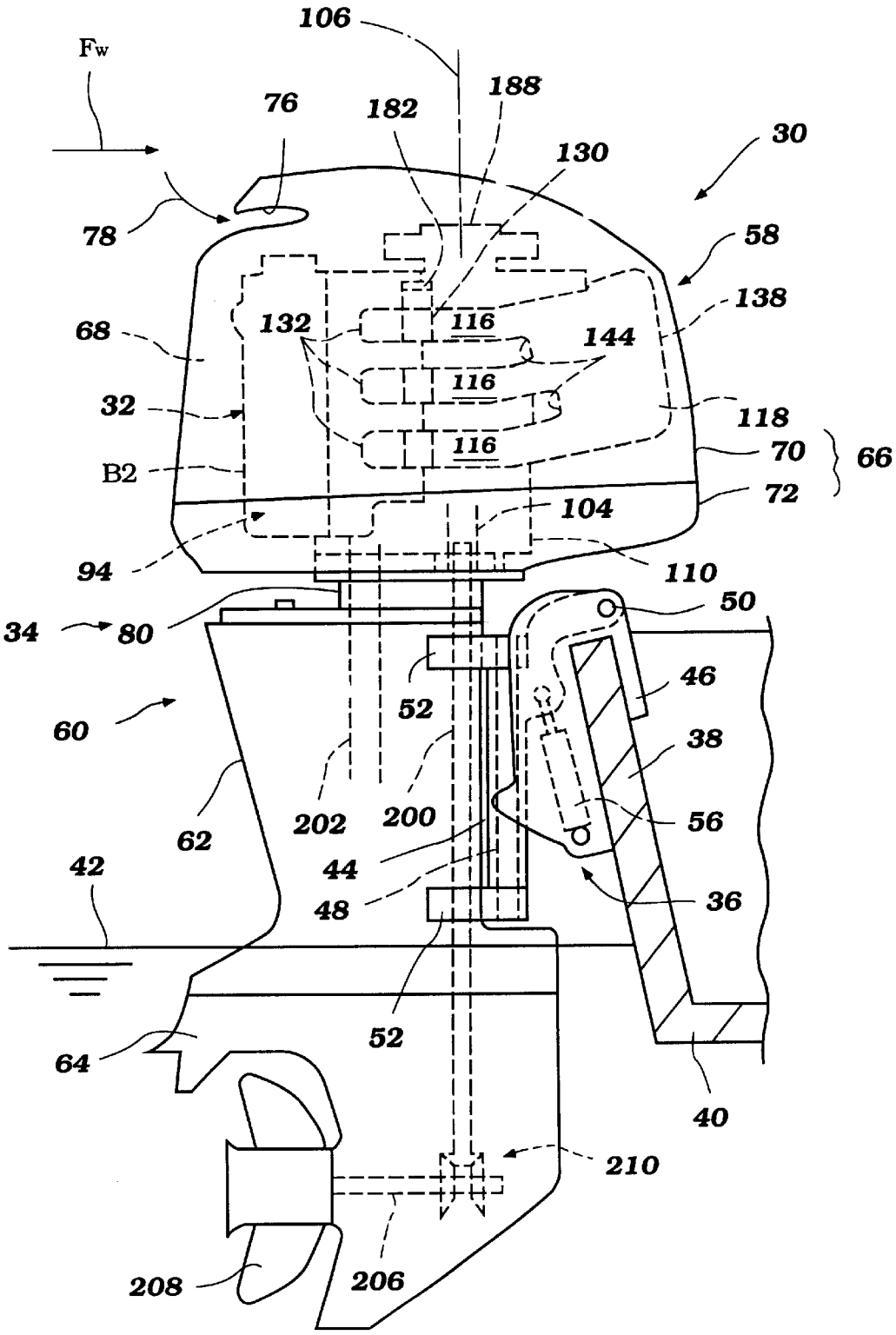
FIG. 1 is a side elevation view of an outboard motor configured in accordance with certain features, aspects and advantages of the present invention. An associated watercraft is partially shown in section.
Figure 2:
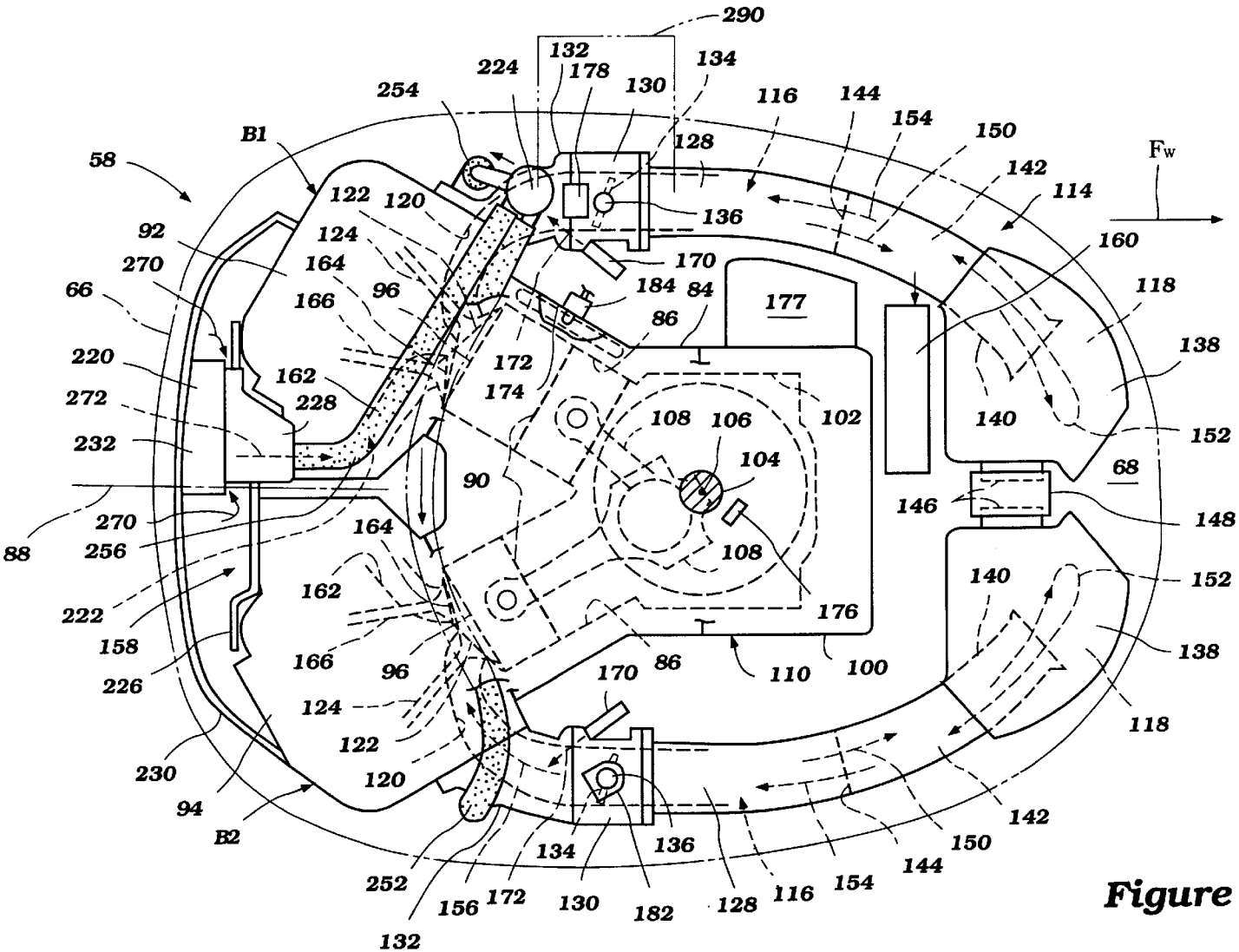
FIG. 2 is a top plan view of an engine that is adapted for use in the outboard motor of FIG. 1. A protective cowling is shown in phantom line.

With reference to FIGS. 1 and 2, an overall construction of an outboard motor 30 that employs an internal combustion engine 32 configured in accordance with certain features, aspects and advantages of the present invention will be described. The engine 32 has particular utility in the context of a marine drive, such as the outboard motor 30 for instance, and thus is described in the context of an outboard motor. The engine 32, however, can be used with other types of marine drives (i.e., inboard motors, inboard/outboard motors, etc.) and also certain land vehicles, which includes lawnmowers, motorcycles, go carts, all terrain vehicles and the like. Furthermore, the engine 32 can be used as a stationary engine for some applications (e.g., generators).

In the illustrated arrangement, the outboard motor 30 generally comprises a drive unit 34 and a bracket assembly 36. The bracket assembly 36 supports the drive unit 34 on a transom 38 of an associated watercraft 40 and places a marine propulsion device in a submerged position with the watercraft 40 resting relative to a surface 42 of a body of water. The bracket assembly 36 preferably comprises a swivel bracket 44, a clamping bracket 46, a steering shaft 48 and a pivot pin 50.

The steering shaft 48 extends through the swivel bracket 44 and is affixed to the drive unit 34 by top and bottom mount assemblies 52. The steering shaft 48 is pivotally journaled for steering movement about a generally vertically extending steering axis defined within the swivel bracket 44. The clamping bracket 46 comprises a pair of bracket arms that preferably are laterally spaced apart from each other and that are attached to the watercraft transom 38.

The pivot pin 50 completes a hinge coupling between the swivel bracket 44 and the clamping bracket 46. The pivot pin 50 preferably extends through the bracket arms so that the clamping bracket 46 supports the swivel bracket 44 for pivotal movement about a generally horizontally extending tilt axis defined by the pivot pin 50. The drive unit 34 thus can be tilted or trimmed about the pivot pin 50.

As used through this description, the terms "forward," "forwardly" and "front" mean at or to the side where the bracket assembly 36 is located, unless indicated otherwise or otherwise readily apparent from the context use. The arrows Fw of FIGS. 1–4 generally indicate the forward direction. The terms "rear," "reverse," "backwardly" and "rearwardly" mean at or to the opposite side of the front side.

A hydraulic tilt and trim adjustment system 56 preferably is provided between the swivel bracket 44 and the clamping bracket 46 for tilt movement (raising or lowering) of the swivel bracket 44 and the drive unit 34 relative to the clamping bracket 46. Otherwise, the outboard motor 30 can have a manually operated system for tilting the drive unit 34. Typically, the term "tilt movement", when used in a broad sense, comprises both a tilt movement and a trim adjustment movement.

The illustrated drive unit 34 comprises a power head 58 and a housing unit 60, which includes a driveshaft housing 62 and a lower unit 64. The power head 58 is disposed atop the housing unit 60 and includes the internal combustion engine 32 that is positioned within a protective cowling assembly 66, which preferably is made of plastic. In most arrangements, the protective cowling assembly 66 defines a generally closed cavity 68 in which the engine 32 is disposed. The engine 32, thus, is generally protected from environmental elements within the enclosure defined by the cowling assembly 66.

The protective cowling assembly 66 preferably comprises a top cowling member 70 and a bottom cowling member 72. The top cowling member 70 preferably is detachably affixed to the bottom cowling member 72 by a coupling mechanism so that a user, operator, mechanic or repairperson can access the engine 32 for maintenance or for other purposes. In some arrangements, the top cowling member 70 is hingedly attached to the bottom member 72 such that the top cowling member 70 can be pivoted away from the bottom cowling member 72 for access to the engine 32. Preferably, such a pivoting allows the top cowling member 70 to be pivoted about the rear end of the outboard motor 30, which facilitates access to the engine 32 from within the associated watercraft 40.

The top cowling member 70 preferably has a rear intake opening 76 defined through an upper rear portion. A rear intake member with one or more air ducts can be unitarily formed with or can be affixed to, the top cowling member 70. The rear intake member, together with the upper rear portion of the top cowling member 70, generally defines a rear air intake space. Ambient air is drawn into the closed cavity 68 via the rear intake opening 76 and the air ducts of the rear intake member as indicated by the arrow 78 of FIG. 1. Typically, the top cowling member 70 tapers in girth toward its top surface, which is in the general proximity of the air intake opening 76. The taper reduces the lateral dimension of the outboard motor, which helps to reduce the air drag on the watercraft during movement.

The bottom cowling member 72 preferably has an opening through which an upper portion of an exhaust guide member 80 extends. The exhaust guide member 80 preferably is made of aluminum alloy and is disposed above the driveshaft housing 62. In one arrangement, the exhaust guide member 80 is affixed atop the driveshaft housing 62. The bottom cowling member 72 and the exhaust guide member 80 together generally form a tray. The engine 32 is positioned generally above the exhaust guide member 80. In one arrangement, the engine 32 can be placed onto this tray and can be affixed to the exhaust guide member 80. The exhaust guide member 80 also defines an exhaust discharge passage through which burnt charges (e.g., exhaust gases) from the engine 32 pass.

The engine 32 in the illustrated embodiment preferably operates on a four-cycle combustion principle. With reference now to FIG. 2, the presently preferred engine 32 has a cylinder block 84 configured in a general V shape. The cylinder block 84 thus defines two cylinder banks B1, B2 which extend somewhat side by side with each other. In the illustrated arrangement, the cylinder bank B1 is disposed on the port side, while the cylinder bank B2 is disposed on the starboard side. Also, in the illustrated arrangement, each cylinder bank B1, B2 has three cylinder bores 86 such that the cylinder block 84 has six cylinder bores 86 in total. Thus, the illustrated arrangement features a V-6 engine. The cylinder bores 86 of each bank B1, B2 extend generally horizontally and are generally vertically spaced from one another.

As used in this description, the term "horizontally" means that the subject portions, members or components extend generally in parallel to the water surface 42 (i.e., generally normal to the direction of gravity) when the associated watercraft 40 is substantially stationary with respect to the water surface 42 and when the drive unit 34 is not tilted (i.e., is placed in the position shown in FIG. 1). The term "vertically" in turn means that portions, members or components extend generally normal to those that extend horizontally.

The illustrated engine 32 generally is symmetrical about a longitudinal center plane 88 that extends generally vertically and fore to aft of the outboard motor 30. This type of engine, however, merely exemplifies one type of engine on which various aspects and features of the present invention can be suitably used. Engines having other numbers of cylinders, having other cylinder arrangements (in-line, opposing, etc.), and operating on other combustion principles (e.g., crankcase compression two-stroke or rotary) also can employ various features, aspects and advantages of the present invention. In addition, the engine can be formed with separate cylinder bodies rather than a number of cylinder bores formed in a cylinder block. Regardless of the particular construction, the engine preferably comprises an engine body that includes at least one cylinder bore.

A moveable member, such as a reciprocating piston 90, moves relative to the cylinder block 84 in a suitable manner. In the illustrated arrangement, a piston 90 reciprocates within each cylinder bore 86. Because the cylinder block 84 is split into the two cylinder banks B1, B2, each cylinder bank B1, B2 extends outward at an angle to an independent first end in the illustrated arrangement. A cylinder head assembly or member 92 is affixed to the first end of the cylinder bank B1 to close that end of the cylinder bores 86 on this bank B1 and another cylinder head assembly or member 94 is affixed to the first end of the cylinder bank B2 to close that end of the cylinder bores 86 on this bank B2. The cylinder head assemblies 92, 94, together with the associated pistons 90 and cylinder bores 86, preferably define six combustion chambers 96. Of course, the number of combustion chambers can vary, as indicated above.

A crankcase member 100 closes the other end of the cylinder bores 86 and, together with the cylinder block 84, defines a crankcase chamber 102. A crankshaft 104 extends generally vertically through the crankcase chamber 102 and can be journaled for rotation about a rotational axis 106 by several bearing blocks. The rotational axis 106 of the crankshaft 104 preferably is on the longitudinal center plane 88. Connecting rods 108 couple the crankshaft 104 with the respective pistons 90 in any suitable manner. Thus, the reciprocal movement of the pistons 90 rotates the crankshaft 104.

Preferably, the crankcase member 100 is located at the forward-most position of the engine 32, with the cylinder block 84 and the cylinder head assemblies 92, 94 being disposed rearward from the crankcase member 100, one after another. Generally, the cylinder block 84 (or individual cylinder bodies), the cylinder head assemblies 92, 94 and the crankcase member 100 together define an engine body 110. Preferably, at least these major engine portions 84, 92, 94, 100 are made of aluminum alloy. The aluminum alloy advantageously increases strength over cast iron while decreasing the weight of the engine body 110.

The engine 32 also comprises an air induction system 114. The air induction system 114 draws air from within the cavity 68 and supplies the air to the combustion chambers 96. The air induction system 114 preferably comprises six primary intake passages 116 and a pair of primary plenum chambers 118. In the illustrated arrangement, each cylinder bank B1, B2 is allotted with three intake passages 116 and one plenum chamber 118. The number of primary intake passages 116 can vary as described above.

The most-downstream portions of the illustrated intake passages 116 are defined within the cylinder head assemblies 92, 94 as inner intake passages 120. The inner intake passages 120 communicate with the combustion chambers 96 through intake ports 122, which are formed at inner surfaces of the cylinder head assemblies 92, 94. Typically, each of the combustion chambers 96 has one or more intake ports 122. Intake valves 124 are slideably disposed at each cylinder head assembly 92, 94 to move between an open position and a closed position. As such, the valves 124 act to open and close the ports 122 to control the flow of air into the combustion chamber 96. Biasing members, such as springs, are used to urge the intake valves 124 toward the respective closed positions by acting between a mounting boss formed on each cylinder head assembly 92, 94 and a corresponding retainer that is affixed to each of the valves 124. When each intake valve 124 is in the open position, the inner intake passage 120 that is associated with the intake port 122 communicates with the associated combustion chamber 96.

Outer portions of the intake passages 116, which are disposed outside of the cylinder head assemblies 92, 94, preferably are defined with intake conduits or conduit members 128. Each illustrated intake conduit 128 includes a throttle body 130. In the illustrated arrangement, downstream portions of the intake conduits 128 extending between the throttle bodies 130 and the cylinder head assemblies 92, 94 on both banks B1, B2 are unified with each other to define conduit blocks 132 (see FIG. 3). In this manner, the downstream portions of the illustrated intake conduits 128 are formed as a monolithic structure. Upstream portions of the illustrated intake conduits 128 are separated from each other. The conduit blocks 132 and the throttle bodies 130 preferably are made of aluminum alloy. The separate intake conduits 128 preferably are made of plastic. While the intake conduits 128 allotted to the cylinder bank B1 extend forwardly along a side surface of the engine body 110 on the port side from the cylinder head assembly 92 to the front of the crankcase member 100, the intake conduits 128 allotted to the cylinder bank B2 extend forwardly along a side surface of the engine body 110 on the starboard side from the cylinder head assembly 94 to the front of the crankcase member 100.

With reference again to FIG. 2, each throttle body 130 preferably contains a throttle valve 134. Preferably, the throttle valves 134 are butterfly valves that have valve shafts 136 journaled for pivotal movement about a generally vertical axis. The valve shafts 136 are linked together and are connected to a control linkage. The control linkage would be connected to an operational member, such as a throttle lever, that is provided on the watercraft or otherwise provided proximate the operator of the watercraft.

The operator can control the opening degree of the throttle valves 134 in accordance with operator demand through the control linkage. That is, the throttle valve assemblies 130 can measure or regulate amounts of air that flow through the intake passages 116 to the combustion chambers 96 in response to the operation of the operational member by the operator. Normally, the greater the opening degree, the higher the rate of airflow and the higher the engine speed. As is well understood, the plenum chambers 118 and the portions of the intake passages 116 located upstream of the throttle valves 134 are on the atmosphere side.

The respective plenum chambers 118 preferably are defined with plenum chamber units 138 which are disposed side by side in front of the crankcase member 100. Preferably, the plenum chamber units 138 are arranged substantially symmetrically relative to the longitudinal center plane 88. In the illustrated arrangement, each forward end portion 140 of the intake conduits 128 is housed within each plenum chamber unit 138. Each plenum chamber unit 138 preferably has two air inlet passages 142, which extend generally rearwardly between the respective intake conduits 128. That is, two of the intake conduits 128 are formed with one inlet passage 142 extending therebetween (see FIG. 1). The respective air inlet passages 142 define inlet openings 144 through which air is drawn into the plenum chambers 118. The inlet passages 142 are relatively long and can add length to the intake passages 128. This arrangement is advantageous because the air induction system 114 can improve the engine torque in a low and/or middle range of the engine speed by facilitating better tuning of the intake system.

The plenum chamber units 138 also have other two openings 146 which are defined on another side and which are vertically spaced apart from one another. The openings 146 of one plenum chamber unit 138 preferably are formed opposite to the openings 146 of the other plenum chamber unit 138 and are coupled with each other by balancer pipes 148. Advantageously, this construction provides a manner of roughly equalizing the pressures within each chamber unit 138.

The plenum chambers 118 coordinate air delivered to each intake passage 116 and also act as silencers to reduce intake noise. In other words, the chambers 118 act to reduce the pulsation energy within the intake system and to smooth the airflow being introduced to the engine. The air in both of the chambers 118 also is coordinated with one another through the balancer pipes 148. The plenum chamber units 138 and the balancer pipes 148 preferably are made of plastic. In some arrangements, each plenum chamber unit 138 can be unitarily formed with the separate portions of the intake conduits 128 associated with the plenum chamber unit 138.

The air within the closed cavity 68 is drawn into the plenum chambers 118 through the inlet openings 144 as indicated by the arrows 150 of FIG. 2. The air flow slows within the plenum chambers 118 to reduce pulsations and then enters the outer intake passages 116 through the end portions 140, as indicated by the arrows 152 of FIG. 2. The air passes through the outer intake passages 116 and flows into the inner intake passages 120 as indicated by the arrows 154, 156 of FIG. 2. As described, the level of airflow is measured by the throttle valves 134 before the air enters the inner intake passages 120.

In the illustrated embodiment, the throttle valves 134 are substantially closed to bring the engine 32 to roughly a desired idle speed and to generally maintain this speed. Preferably, the throttle valves 134 are not fully closed such that the likelihood of throttle valve sticking can be reduced. As used throughout the description, the term "idle speed" generally means a low engine speed that is achieved when the throttle valves 134 are substantially closed but also includes a state in which the valves 134 are slightly opened to allow a small level of airflow through the intake passages 116. Also, the outboard motor 30 is often used for trolling, which is a very low speed, generally forward movement of the watercraft 40. Thus, when trolling, a shift mechanism, which will be described later, is in a forward position and the engine 32 basically operates in the idle speed. Thus, idle speed may be construed to refer to both situations: throttle valves substantially closed (or slightly open) and in neutral and throttle valves substantially closed (or slightly open) and in gear.

The illustrated air induction system 114 preferably includes an idle or auxiliary air delivery mechanism 158 that can deliver idle air to the combustion chambers 96 when the throttle valves 134 are substantially closed. The downstream portion of the auxiliary air delivery mechanism 158 is connected to the air intake passages 116 downstream of the throttle valves 134. Because the illustrated auxiliary air delivery mechanism 158 generally acts as an idle speed control (ISC) mechanism, the auxiliary air delivery mechanism will be called an as ISC mechanism for short within this description unless otherwise indicated.

In the illustrated embodiment, the ISC mechanism 158 can supply additional air to the intake passages 116 in response to various operational conditions of the engine 32 other than the idle control. For instance, when an engine temperature is lower than a preset temperature, the ISC mechanism 158 increases air supply so that the engine speed is held slightly higher than the idle speed. That is, the increased air can reduce the likelihood of engine stall under a cold conditions. Also, when the throttle valves 134 are suddenly closed under the force of a biasing member, i.e., the operator is making a sudden deceleration of the engine operation, the ISC mechanism 158 can increase air supply to prevent the engine stall also. Additionally, when the operator suddenly operates the throttle valves 134 to increase the air amount, i.e., to abruptly accelerate the engine speed, a huge amount of air, which is more than accommodated by the maximum airflow through the intake conduits 116, can be required. Under this condition, the ISC mechanism 158 also can supplement the air flow. These operations, as well as the idle operation, preferably are controlled by an electronic control unit (ECU) 160. The ISC mechanism 158, including some of the controls, will be described in detail below with additional reference to FIGS. 3 and 4.

The engine 32 also includes an exhaust system that routes burnt charges, i.e., exhaust gases, to a location outside of the outboard motor 30. Each cylinder head assembly 92, 94 defines a set of inner exhaust passages 162 that communicate with the combustion chambers 96 through one or more exhaust ports 164, which may be defined at the inner surfaces of the respective cylinder head assemblies 92, 94. The exhaust ports 164 can be selectively opened and closed by exhaust valves 166. The construction of each exhaust valve and the arrangement of the exhaust valves are substantially the same as the intake valve. Thus, further description of these components is deemed unnecessary.

Exhaust manifolds preferably are defined generally vertically within the cylinder head assemblies 92, 94, although they also can be defined within the cylinder block 84 and between the cylinder bores 86 of both the cylinder banks B1, B2. The exhaust manifolds communicate with the combustion chambers 96 through the inner exhaust passages 162 and the exhaust ports 164 to collect exhaust gases therefrom. The exhaust manifolds are coupled with the exhaust discharge passage of the exhaust guide member 80. When the exhaust ports 164 are opened, the combustion chambers 96 communicate with the exhaust discharge passage through the exhaust manifolds.

A valve cam mechanism (not shown) preferably is provided for actuating the intake and exhaust valves 124, 166 in each cylinder bank B1, B2. Preferably, the valve cam mechanism includes one or more camshafts per cylinder bank, which camshafts extend generally vertically and are journaled for rotation relative to the cylinder head assemblies 92, 94. The camshafts have cam lobes to push valve lifters that are affixed to the respective ends of the intake and exhaust valves 124, 166 in any suitable manner. The cam lobes repeatedly push the valve lifters in a timed manner, which is in proportion to the engine speed. The movement of the lifters generally is timed by rotation of the camshafts to appropriately actuate the intake and exhaust valves 124, 166.

A camshaft drive mechanism (not shown) preferably is provided for driving the valve cam mechanism. Thus, the intake and exhaust camshafts comprise intake and exhaust driven sprockets positioned atop the intake and exhaust camshafts, respectively, while the crankshaft 104 has a drive sprocket positioned atop thereof. A timing chain or belt is wound around the driven sprockets and the drive sprocket. The crankshaft 104 thus drives the respective camshafts through the timing chain in the timed relationship. Because the camshafts must rotate at half of the speed of the rotation of the crankshaft 104 in a four-cycle engine, a diameter of the driven sprockets is twice as large as a diameter of the drive sprocket.

The engine 32 preferably has an indirect, port or intake passage fuel injection system. The fuel injection system preferably comprises six fuel injectors 170 with one fuel injector allotted for each one of the respective combustion chambers 96. The fuel injectors 170 preferably are mounted on the throttle bodies 130 and a pair of fuel rails connects the respective fuel injectors 170 with each other on each cylinder bank B1, B2. The fuel rails also define portions of the fuel conduits to deliver fuel to the injectors 170.

Each fuel injector 170 preferably has an injection nozzle directed downstream within the associated intake passage 116, which is downstream of the throttle valves 134. The fuel injectors 170 spray fuel into the intake passages 116, as indicated by the arrows 172 of FIG. 2, under control of the ECU 160. The fuel injectors 170 are connected to the ECU 160 through appropriate control lines. The ECU 160 controls both the initiation timing and the duration of the fuel injection cycle of the fuel injectors 170 so that the nozzles spray a proper amount of fuel each combustion cycle.

The ECU 160 preferably is disposed between a forward surface of the crankcase member 100 and the plenum chamber unit 138 on the port side, and preferably is mounted on the forward surface of the crankcase member 100. Air is drawn over the ECU 160 to help cool the ECU 160 during operation of the engine 32.

Typically, a fuel supply tank disposed on a hull of the associated watercraft 40 contains the fuel. The fuel is delivered to the fuel rails through the fuel conduits and at least one fuel pump, which is arranged along the conduits. The fuel pump pressurizes the fuel to the fuel rails and finally to the fuel injectors 170. A vapor separator 177 preferably is disposed along the conduits to separate vapor from the fuel and can be mounted on the engine body 110 at the side surface on the port side. The vapor can be delivered to the plenum chamber 118 for delivery to the combustion chambers 96 together with the air for combustion. In other applications, the engine 32 can be provided with a ventilation system arranged to send lubricant vapor to the plenum chambers. A direct fuel injection system that sprays fuel directly into the combustion chambers can replace the indirect fuel injection system described above. In other applications, any other charge forming devices, such as carburetors, can be used.

The engine 32 further comprises an ignition or firing system (not shown). Each combustion chamber 96 is provided with a spark plug which preferably is disposed between the intake and exhaust valves 124, 166. Each spark plug has electrodes that are exposed inside the associated combustion chamber 96. The electrodes are spaced apart from each other with a small gap. The spark plugs are connected to the ECU 160 through appropriate control lines and ignition coils. The spark plugs generate a spark between the electrodes to ignite an air/fuel charge in the combustion chamber 96 at selected ignition timing under control of the ECU 160.

The engine 32 also comprises an open-loop type, water cooling system. The cooling system introduces water into the system from the body of water surrounding the outboard motor 30 by an appropriate water pump. The water moves through water jackets such as, for example, a cylinder block jacket 174 disposed around the cylinder bores 86 to cool the engine 32. The water further cools internal sections of the exhaust system within the housing unit 60 and then is discharged to the body of water.

For use by the ECU 160, the engine 32 may have various sensors. In the illustrated embodiment, a crankshaft angle position sensor 176 preferably is provided to monitor the crankshaft 104. The angle position sensor 176, when measuring crankshaft angle versus time, outputs a crankshaft rotational speed signal or an engine speed signal that is sent to the ECU 160 through a sensor signal line. The sensor 176 preferably comprises a pulsar coil positioned adjacent to the crankshaft 104 and a projection or cut formed on the crankshaft 104. The pulsar coil generates a pulse when the projection or cut passes proximate the pulsar coil. In some arrangements, the number of pulses can be counted. The sensor 176 thus can sense not only a specific crankshaft angle but also a rotational speed of the crankshaft 104, i.e., engine speed. Of course, other types of speed sensors and other placements also can be used.

An air intake pressure sensor 178 preferably is positioned atop the uppermost throttle body 130 for the intake passage 116 of the cylinder bank B1 on the port side. The intake pressure sensor 178 senses the intake pressure in this passage 116 during engine operation. The sensed signal is sent to the ECU 160 through another sensor signal line. This signal can be used for determining engine load. Other suitable placements of the sensor also can be used and other sensors that can determine engine load can be used.

A throttle valve position sensor 182 preferably is provided atop and proximate the valve shaft 136 of the upper-most throttle valve 134 for the intake passage 116 of the cylinder bank B2 on the starboard side. The throttle valve position sensor 182 senses an opening degree or opening position of the throttle valves 134. A sensed signal is sent to the ECU 160 through a further sensor signal line. Other sensors and placements also can be used.

An engine temperature sensor 184 preferably is provided at a side surface of the cylinder block 84 of the cylinder bank B1 on the port side. The illustrated temperature sensor 184 has a sensor tip disposed in the water jacket 174 to sense a water temperature as the engine temperature. A sensed signal is sent to the ECU 160 through a still another sensor signal line. Of course, other sensors and other placements can be used.

While the illustrated arrangement features hard-wired sensors and components, the signals can be sent through emitter and detector pairs, infrared radiation, radio waves or the like. The type of signal and the type of connection can be varied between sensors or the same type can be used with all sensors.

In the illustrated engine 32, the pistons 90 reciprocate between top dead center and bottom dead center. When the crankshaft 104 makes two rotations, the pistons 90 generally move from the top dead center position to the bottom dead center position (the intake stroke), from the bottom dead center position to the top dead center position (the compression stroke), from the top dead center position to the bottom dead center position (the power stroke) and from the bottom dead center position to the top dead center position (the exhaust stroke). During the four strokes of the pistons 90, the camshafts make one rotation and actuate the intake and exhaust valves 124, 166 to open the intake and exhaust ports 122, 164 during the intake stroke and the exhaust stroke, respectively.

Generally, during the intake stroke, air is drawn into the combustion chambers 96 through the air intake passages 116 and fuel is injected into the intake passages 116 by the fuel injectors 170. The air and the fuel thus are mixed to form the air/fuel charge in the combustion chambers 96. The air/fuel ratio is generally held in the optimum condition under control of the ECU 160 by determining an amount of the fuel in corresponding to an amount of the air. Slightly before or during the power stroke, the respective spark plugs ignite the compressed air/fuel charge in the respective combustion chambers 96. The air/fuel charge thus rapidly bums and expands during the power stroke to move the pistons 90. The burnt charge, i.e., exhaust gases, then are discharged from the combustion chambers 96 during the exhaust stroke.

A flywheel assembly 188 preferably is positioned atop of the crankshaft 104 and is mounted for rotation with the crankshaft 104. The flywheel assembly 188 comprises a flywheel magneto or AC generator that supplies electric power to various electrical components, such as the ISC mechanism 158, the fuel injection system, the ignition system and the ECU 160.

It should be noted that the engine 32 may comprise other systems, mechanisms and devices other than those described above. For example, a lubrication system can be provided to lubricate engine portions that need lubrication. The foregoing systems, mechanisms and devices also are generally disclosed in the following co-pending U.S. applications: AIR INDUCTION SYSTEM FOR ENGINE, Ser. No. 09/906570, filed Jul. 16, 2001, SENSOR ARRANGEMENT FOR ENGINE, Ser. No. 09/906389, WATER COOLING SYSTEM FOR ENGINE, Ser. No. 09/952,857, filed Sep. 13, 2001 and AIR INDUCTION SYSTEM FOR ENGINE, Ser. No. 09/965,650, filed Sep. 26, 2001, the disclosures of which are hereby incorporated by reference.

With reference again to FIG. 1, the driveshaft housing 62 is positioned below the exhaust guide member 80 to support a driveshaft 200 which extends generally vertically through the driveshaft housing 62. The driveshaft 200 is journaled for rotation and is driven by the crankshaft 104. The driveshaft housing 62 preferably defines an internal section 202 of the exhaust system that leads the majority of exhaust gases to the lower unit 64. The internal section 202 preferably includes an idle discharge portion that is branched off from a main portion of the internal section 202 to discharge idle exhaust gases directly out to the atmosphere when the engine is idling through a discharge port that preferably is formed on a rear surface of the driveshaft housing 62. The exhaust internal section 202 is schematically shown in FIG. 1 to include a portion of the exhaust manifolds and the exhaust discharge passage.

The lower unit 64 depends from the driveshaft housing 62 and supports a propulsion shaft 206 that is driven by the driveshaft 200. The propulsion shaft 206 extends generally horizontally through the lower unit 64 and is journaled for rotation. A propulsion device is attached to the propulsion shaft 206. In the illustrated arrangement, the propulsion device is a propeller 208 that is affixed to an outer end of the propulsion shaft 206. The propulsion device, however, can take the form of a dual counter-rotating system, a hydrodynamic jet, or any of a number of other suitable propulsion devices.

A transmission 210 preferably is provided between the driveshaft 200 and the propulsion shaft 206, which lie generally normal to each other (i.e., at a 90° shaft angle) to couple together the two shafts 200, 206 by bevel gears. The outboard motor 30 has a clutch mechanism that allows the transmission 210 to change the rotational direction of the propeller 208 among forward, neutral or reverse.

The lower unit 64 also defines an internal section of the exhaust system that is connected with the internal exhaust section 202 of the driveshaft housing 62. At engine speeds above idle, the exhaust gases generally are discharged to the body of water surrounding the outboard motor 30 through the internal sections and then a discharge section defined within the hub of the propeller 208. Additionally, the exhaust system can include a catalytic device at any location in the exhaust system to purify the exhaust gases.

Figure 3:
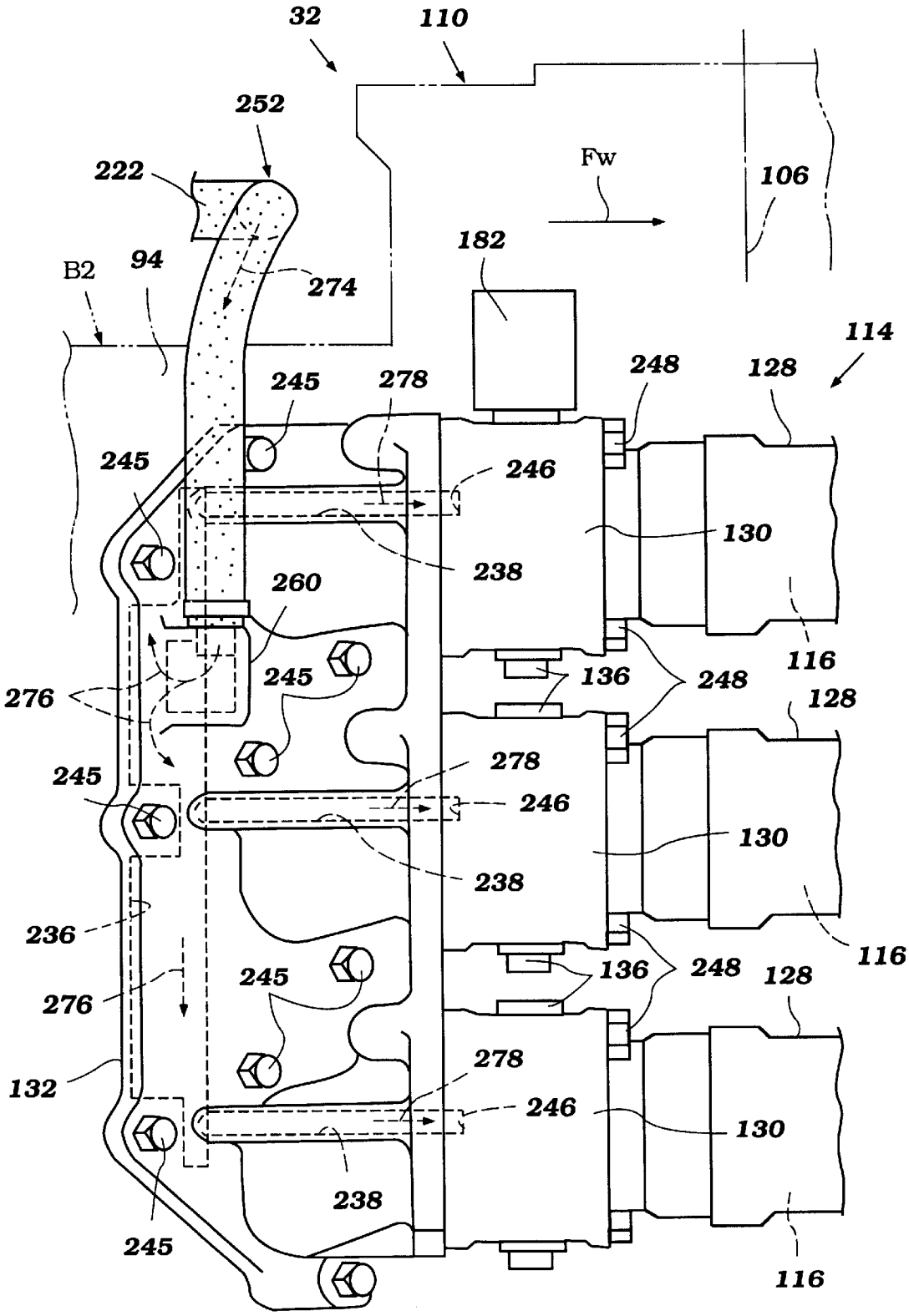
FIG. 3 is an enlarged side elevation view of the engine of FIG. 2 partially showing an auxiliary air supply arrangement on the starboard side.
Figure 4:
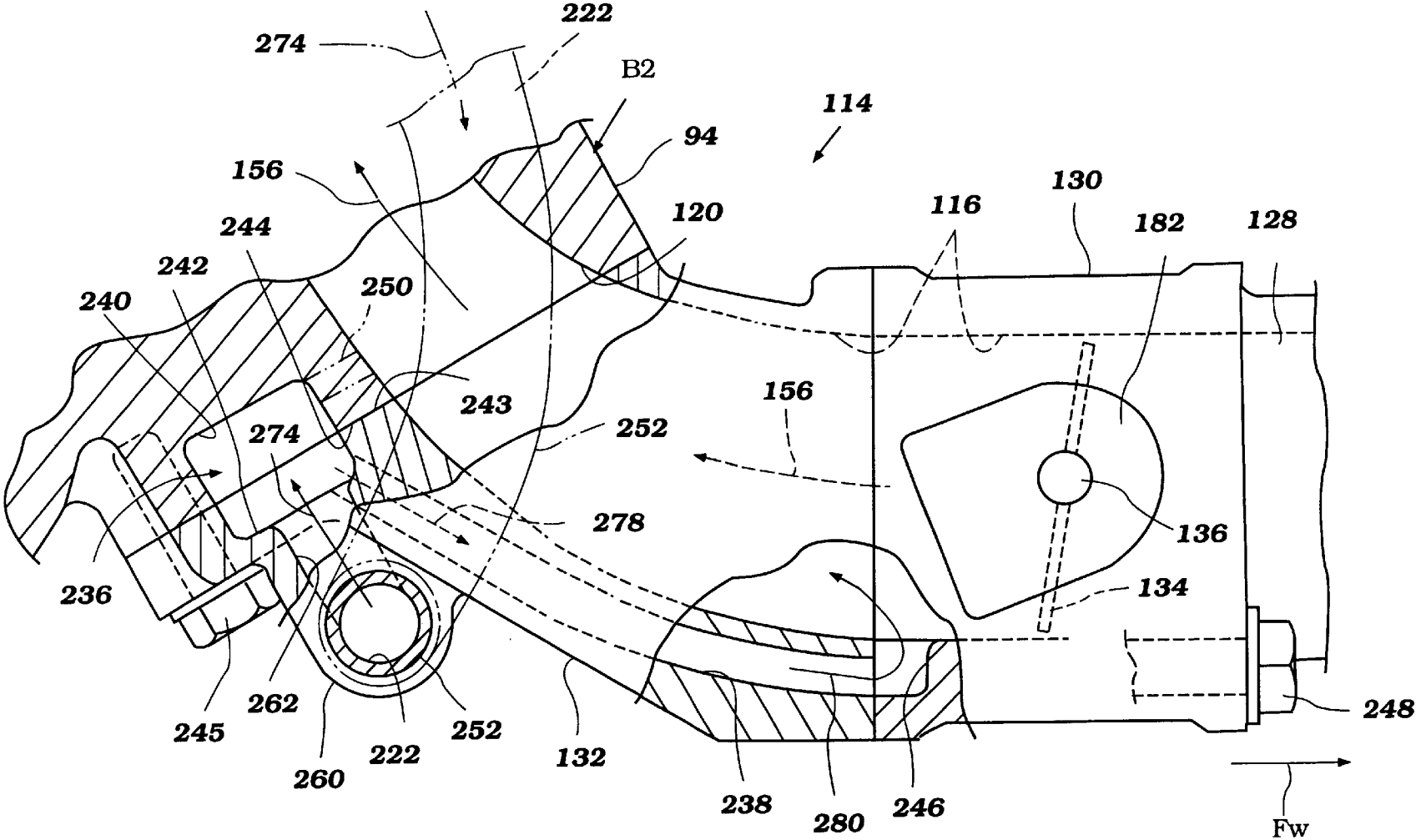
FIG. 4 is an enlarged top plan view of the engine of FIG. 2 showing a portion of the auxiliary air supply arrangement of FIG. 3.

With reference still to FIGS. 1 and 2, and additionally with reference to FIGS. 3 and 4, the ISC mechanism 158 preferably comprises an auxiliary plenum chamber 220, an auxiliary passage or secondary passage 222 and an ISC device 224. Preferably, the auxiliary plenum chamber 220 is defined separately from the primary plenum chambers 118 and is generally disposed in a rear space of the cavity 68 opposite to the plenum chambers 118.

In the illustrated embodiment, the auxiliary plenum chamber 220 preferably is defined with two members. One of the members is a bracket member 226 affixed to the cylinder head assemblies 92, 94. The bracket member 226 primarily is provided to support the ignition coils of the firing system. The bracket member 226 has a cup-like portion 228 that opens rearwardly. The cup-like portion 228 is positioned generally between both of the cylinder head assemblies 92, 94. The other member in turn is a cover member 230 also affixed to the cylinder head assemblies 92, 94 to cover the ignition coils. The cover member 230 also has a cup-like portion 232 that opens forwardly to meet with the opening of the cup-like portion 228 of the bracket member 226. The opening of the cup-like portion 232 has an inner diameter greater than an outer diameter of the opening of the cup-like portion 228. A gap thus is made between both the openings and the air in the closed cavity 68 can move into the auxiliary plenum chamber 220 accordingly. Both the bracket and cover members 226, 230 preferably are made of plastic. As thus constructed and arranged, the auxiliary plenum chamber 220 coordinates air therein and/or acts as a silencer.

With reference to FIGS. 3 and 4, the auxiliary passage 222 includes a pair of common chambers 236 and multiple runners 238. The cylinder head assemblies 92, 94 and the conduit blocks 132 together define the common chambers 236. Although FIGS. 3 and 4 only show a structure of the bank B2 on the starboard side, another structure on the port side of the bank B1 is substantially the same. The structure on the starboard side thus is described and no further description of the structure on the port side is deemed necessary.

The cylinder head assembly 94 comprises a recess 240, while the associated conduit block 132 also defines a recess 242, as shown in FIG. 4. Both of the recesses 240, 242 extend generally vertically next to the intake passages 116 in the illustrated arrangement. The recesses 240, 242 together form the common chamber 236. Alternatively, at least one of the recesses 240, 242 can form the common chamber 236 if the recess has a sufficient volume. Other members can be interposed between the two components to expand the recess volume, if desired.

Defining the common chambers 236 with the recesses 240, 242 on the respective outer surfaces 244, 243 is advantageous because the recesses 243, 244 are easily formed by, for example, casting and/or machining processes. Also, the outer surfaces 243, 244 are firmly connected together to effect proper sealing of the intake passages 116. The common chambers 236 thus can be simply and effectively sealed. Furthermore, the illustrated arrangement makes advantageous use of space while placing the common chambers 236 very close to the combustion chambers.

The conduit member 132 is affixed to the cylinder head assembly 94 by appropriate fasteners such as, for example, bolts 245. The conduit member 132 is coupled with the cylinder head assembly 92, 94 at respective outer surfaces 243, 244 via a gasket (not shown). Furthermore, the illustrated throttle bodies 130 are affixed to the conduit block 132 by appropriate fasteners such as, for example, bolts 248.

The conduit block 132 preferably defines major part of the runners 238. The balance of the runners 238 can be formed in the throttle bodies 130. That is, the respective runners 238 extend from the common chamber 236 toward the throttle bodies 130 to communicate with the intake passages 116 within a portion of the throttle bodies 130. The communication portion preferably comprises communicating openings 246 that are defined just downstream of the throttle valves 134.

The injection nozzles of the fuel injectors 170 preferably are located downstream of the communicating openings 246. In one application, the injection nozzles are disposed at generally the same position as of the communicating openings 246. In other applications, the injection nozzles can be located slightly upstream of the openings 246 and can be directed toward a location downstream of the communicating openings 246. The respective runners 238 preferably extend generally horizontally along the associated intake passages 116 and the length of each runner 238 preferably is substantially the same as the others. Thus, in such an arrangement, the common chamber 236 is separated from the respective intake passages 116 by generally the same distance.

The positioning relationships between the injection nozzles of the fuel injectors 170 and the communicating openings 246 thus described are advantageous because the fuel sprayed by the fuel injectors 170 generally does not enter the communicating openings 246. If the fuel were directed into the communicating openings 246, the fuel may pass between intake passages 116 through the runners 238 which would upset the air/fuel ratio from the desired range.

As described above, the engine 32 can employ a direct fuel injection system. If a direct fuel injection system were used, the runners 238 could be shortened relative to those shown in FIGS. 3 and 4. For example, alternative runners 250 are shown in phantom in FIG. 4, which extend directly into the intake passage from the common chamber without reverting to the throttle bodies. In other words, the runners 250 could be formed within the cylinder head assemblies 92, 94. A similar construction also could be used with an indirect injection system that has fuel injectors positioned in proximity to the intake ports 122.

Due to the environment in which the illustrated ISC device 224 is used, mounting location of the ISC device 224 also forms an aspect of the present invention. While other positions may be possible, the illustrated positioning is greatly preferred. The closed cavity 68 of the protective cowling assembly 66 is quite narrow and, therefore, very limited space is available in which the ISC device 224 can be positioned. In addition, the ISC device 224 desirably is protected from water that infiltrates the closed cavity. Thus, a housing of the ISC device 224 preferably is disposed atop the conduit block 132 of the cylinder bank B1 on the port side. In some applications, the ISC device 224 can be positioned on the starboard side. In one arrangement, the ISC device 224 can be affixed to the conduit block 132 by appropriate fasteners, such as bolts. Other suitable techniques of mounting the ISC device 224 also can be used.

The illustrated ISC device 224 contains an ISC valve or control valve that preferably is formed with, for example, a needle valve actuated by a solenoid actuator to measure or regulate an amount of the air flowing through the ISC device 224. Preferably, the valve is controlled by the ECU 160. In some arrangements, a butterfly valve (preferably electrically controlled) can be used.

A control line (not shown) connects the ISC valve with the ECU 160. The ISC valve can move between an open position and a closed position. The ISC valve allows a certain amount of air corresponding to an opening degree thereof to pass through the ISC device 224. While placed in the closed position, the ISC valve preferably completely closes the flow path through the ISC device 224. In the illustrated arrangement, the ISC valve is placed in the closed position by the ECU 160 under normal operating conditions.

The portion of the auxiliary passage 222 that does not include the common chamber 236 and the runners 238 connects the auxiliary plenum chamber 220 with the common chamber 236 through the ISC device 224. This portion of the illustrated auxiliary passage 222 can be formed with three single pipes 252, 254, 256 made of an elastic material such as, for example, a rubber material. Other suitable constructions also can be used.

In the illustrated arrangement, the pipe 252 connects the common chamber 236 of the bank B2 with the ISC device 224, the pipe 254 connects the common chamber 236 of the bank B1 also with the ISC device 224, and the pipe 256 connects the ISC device 224 with the auxiliary plenum chamber 220. Each conduit block 132 has a projection 260 in which a pathway 262 communicating with the common chamber 236 is formed. The pipe 252 is fitted into the pathway 262 of the bank B2 and extends generally vertically upward. The pipe 252 then transversely crosses over the both cylinder banks B1, B2 toward the ISC device 224. The pipe 254 extends generally vertically upward from the pathway of the bank B1 toward the ISC device 224. The pipe 256 in turn crosses over the cylinder bank B1 from the ISC device 224 toward the auxiliary plenum chamber 220. A length of the pipe 252 preferably is longer than each length of the runners 238. In fact, the total length of the pipes 252, 254, 256 are longer than each length of the runners 238 in the illustrated arrangement.

With reference still to FIGS. 2–4, the air in the closed cavity 68 of the protective cowling assembly 66 is drawn to the auxiliary plenum chamber 220 through the gap made between the cup-like portions 228, 232 as indicated by the arrows 270 of FIG. 2. The air then moves to the ISC device 224 through the portion of the auxiliary passage 222 defined with the pipe 256 as indicated by the arrow 272 of FIG. 2. The ISC valve in the ISC device 224 controls further flow within the ISC system under the control of the ECU 160 in response to engine operating conditions. The ECU 160 uses the various sensor signals to determine the engine operating conditions. For example, while the throttle valves 134 are almost closed, i.e., under the idle condition, the ECU 160 controls the ISC valve to be in the open position using the signal from the throttle valve position sensor 182 to allow the air move downstream.

Desirably, the opening degree of the ISC valve can be selectively changed to maintain the foregoing trolling condition. For instance, a control map may control opening degrees that are contingent upon various sensed operating parameters (e.g., engine temperature, atmospheric temperature, atmospheric pressure, transmission position, etc.). While the engine 32 is in the warming-up operation, using the signal from the engine temperature sensor 184, the ECU 160 controls the ISC valve to open for supplying supplemental air to slightly increase the engine speed. When the engine 32 is decelerated or accelerated, particularly in instances of sudden engine speed change, the ECU 160, using the signal from the intake pressure sensor 178 and/or the signal from the throttle position sensor 182, controls the ISC valve to inhibit the engine stall or supplement necessary air, respectively. The signal from the crankshaft angle position sensor 176 can be used for the control by the ECU 160, if necessary.

The air passed through the ISC device 224 is split into two flows in the illustrated arrangement. Generally, half of the flow goes to each of the respective common chambers 236 on both of the banks B1, B2 through the portions of the auxiliary passages 222 defined with the pipes 252, 254 as indicated by the arrows 274 of FIGS. 3 and 274. The air in the common chambers 236 are further branched toward the respective runners 238 as indicated by the arrows 276 of FIG. 3. The air then moves through the runners 238 to the respective intake passages 116 as indicated by the arrows 278 of FIGS. 3 and 4. Finally, the air moves into the intake passages 116 through the communicating openings 246 as indicated by the arrow 280 of FIG. 4 and merges together with the air flowing through the intake passages 116 for introduction to the combustion chambers 164.

Because each common chamber 236 has a certain volume and is located very close to the intake passages 116, the air can be quickly supplied to the intake passages 116 even during sudden deceleration or acceleration of the engine. Such a construction makes any delay in the air supply so minimal that it does not substantially affect engine performance. In addition, the arrangement in which the fuel injectors 170 spray the fuel toward the location downstream of the communicating openings 246 advantageously inhibits any fuel from entering the runners 238. The air/fuel ratio thus can be held within a desired range. Otherwise, if the alternative runners 250 are applied, the common chambers 236 can be connected almost directly with the intake passages 116 and almost no delay in air supply will occur.

It should be noted that the auxiliary plenum chamber 220 can be omitted in some applications. Rather, a passageway 290 that bypasses one of the throttle valves (such as that shown in phantom in FIG. 2) can replace the portion of the auxiliary passage 222 defined by the pipe 256 and the auxiliary plenum chamber 220. Such an arrangement would connect the ISC device 224 with the portion of one of the intake passages 116 located upstream of the throttle valve 134.

Of course, the foregoing description is that of a preferred construction having certain features, aspects and advantages in accordance with the present invention. Various changes and modifications may be made to the above-described arrangements without departing from the spirit and scope of the invention, as defined by the appended claims. For instance, throttle valves are not necessarily provided in each intake passage. The plenum chambers can contain common throttle valves instead of the individual throttle valves in the respective intake passages.

What is claimed is:

1. An internal combustion engine comprising an engine body, a plurality of moveable members moveable relative to the engine body, the engine body and the moveable members together defining a plurality of combustion chambers, and an air induction system arranged to introduce air into the combustion chambers, the air induction system including a plurality of first intake passages through which the air at least in part flows to the combustion chambers, at least one valve arranged to regulate an amount of the air flowing through the first intake passages, a plurality of second intake passages through which the air at least in part flows to the combustion chambers, each one of the second intake passages communicating with each one of the first intake passages at a location positioned downstream of the first valve, the second intake passages having a unified portion and ununified portions, the unified portion at least in part defining a common chamber and an air inlet, each one of the ununified portions coupling the common chamber with each one of the first intake passages, and each one of the ununified portions at least in part extending along each one of the first intake passages.

2. The engine as set forth in claim 1 additionally comprising at least one second valve arranged to regulate an amount of the air flowing through the second intake passages.

3. The engine as set forth in claim 2, wherein the second valve is positioned within the unified portion.

4. The engine as set forth in claim 3, wherein the second valve is located apart from the common chamber.

5. The engine as set forth in claim 1, wherein a length of each ununified portion is generally equal to each other.

6. The engine as set forth in claim 1, wherein the common chamber extends adjacent to the first intake passages.

7. The engine as set forth in claim 1 additionally comprising conduit members extending from the engine body, and the conduit members defining at least the first intake passages.

8. The engine as set forth in claim 7, wherein the conduit members further define at least a portion of the common chamber.

9. The engine as set forth in claim 8, wherein portions of the conduit members positioned next to the engine body are unified to form a conduit block and other portions form ununified sections.

10. The engine as set forth in claim 9, wherein the engine body and the conduit block are coupled together to define the common chamber therebetween.

11. The engine as set forth in claim 9, wherein the conduit block defines at least part of the ununified portions of the second intake passages.

12. The engine as set forth in claim 11, wherein a length of each one of the ununified portions is generally equal to each other.

13. The engine as set forth in claim 10, wherein the unified portion except for the common chamber is formed with a second conduit member.

14. The engine as set forth in claim 13, wherein the second conduit member extends from the conduit block.

15. The engine as set forth in claim 1, wherein the air inlet is rearwardly disposed relative to a crankshaft of the engine.

16. The engine as set forth in claim 1 additionally comprising at least one fuel injector arranged to inject fuel into at least one of the first intake passages, the second intake passages communicating with the first intake passages through communicating openings, and the fuel injector spraying the fuel toward a location downstream of one of the communicating openings.

17. The engine as set forth in claim 1, wherein the unified portion opens to the atmosphere through the air inlet.

18. The engine as set forth in claim 1, wherein the unified portion is connected to at least one of the first intake passages at a location upstream of the valve through the air inlet.

19. The engine as set forth in claim 1, wherein the engine operates on a four-cycle combustion principle.

20. The engine as set forth in claim 1, wherein each one of the ununified portions at least in part extends generally parallel to each one of the first intake passages.

21. An internal combustion engine comprising an engine body, a plurality of moveable members moveable relative to the engine body, the engine body and the moveable members together defining a plurality of combustion chambers, and an air induction system arranged to introduce air into the combustion chambers, the air induction system including a plurality of primary passages through which a first portion of air flows to the combustion chambers, at least one valve arranged to regulate an amount of the air flowing through the primary passages, a plurality of first auxiliary passages each having an outlet that communicates with each one of the primary passages at a location positioned downstream of the valve, a common chamber coupled with each inlet of the first auxiliary passages, and a second auxiliary passage having a first end communicating with the common chamber and a second end communicating with a location in the atmosphere, a second portion of air flowing to the combustion chambers through the first and second auxiliary passages and the common chamber, and the first auxiliary passages at least in part extending along the primary passages.

22. The engine as set forth in claim 21, wherein each one of the first auxiliary passages is shorter than the second auxiliary passage.

23. The engine as set forth in claim 21, wherein each one of the first auxiliary passages has a length generally equal to the other first auxiliary passages.

24. The engine as set forth in claim 21, wherein the first auxiliary passages at least in part extend generally parallel to the primary passages.

25. The engine as set forth in claim 21, wherein first portions of the respective primary passages are defined within the engine body, second portions of the respective primary passages are defined within a conduit block, the conduit block is affixed to the engine body so that the first and second portions of the respective primary passages communicate with each other, and at least the engine body or the conduit block forms a recess that defines the common chamber.

26. The engine as set forth in claim 25, wherein at least a portion of each one of the first auxiliary passages extends along each one of the primary passages within the conduit block.

27. The engine as set forth in claim 21, wherein the combustion chambers are separately disposed on first and second sides of the engine body, the air induction system includes at least two of the common chambers and two second auxiliary passages, one of the second auxiliary passages is allotted to the first side, another one of the second auxiliary passages is allotted to the second side, and each one of the second auxiliary passages extends from each one of the common chambers.

28. The engine as set forth in claim 27 additionally comprising a control valve arranged to control the amount of the second portion of air, the control valve being positioned apart from the respective common chambers.

29. The engine as set forth in claim 21 additionally comprising a control valve arranged to control the amount of the second portion of air.

30. The engine as set forth in claim 29, wherein the control valve is positioned apart from the common chamber.

31. The engine as set forth in claim 21, wherein an amount of the second portion of air is smaller than an amount of the first portion of air.

32. The engine as set forth in claim 21 additionally comprising at least one fuel injector arranged to inject fuel into at least one of the primary passages, the first auxiliary passages communicating with the primary passages through communicating openings, and the fuel injector spraying the fuel toward a location downstream of one of the communicating openings.

33. An internal combustion engine comprising an engine body, a plurality of moveable members moveable relative to the engine body, the engine body and the moveable members together defining a plurality of combustion chambers, and an air induction system including intake passages through which a first portion of air flows to the combustion chambers, at least one first valve arranged to regulate an amount of the first portion of air, multiple secondary passages each communicating with each one of the intake passages at a location positioned downstream of the first valve, the multiple secondary passages at least in part extending along the intake passages and being unified with each other to form a common chamber, a single secondary passage having a first end communicating with the common chamber and a second end communicating with a location in the atmosphere, a second portion of air flowing to the combustion chambers through the single and multiple secondary passages and the common chamber, and a second valve arranged to control an amount of the second portion of air, the second valve being positioned in the single secondary passage.

34. The engine as set forth in claim 33, wherein each one of the multiple secondary passages is shorter than a distance between the common chamber and the second valve.

35. The engine as set forth in claim 33 wherein the multiple secondary passages at least in part extend generally parallel to the intake passages.

36. An outboard motor comprising an engine comprising a first cylinder bank and a second cylinder bank, at least one combustion chamber being defined within each cylinder bank, a primary air intake system providing a main air supply to said combustion chambers, said primary air intake system comprising at least one plenum chamber and a plurality of primary intake passages extending between said at least one plenum chamber and said combustion chambers, a corresponding plurality of throttle valves disposed along said plurality of primary intake passages, a first integrated member forming a portion of said plurality of primary intake passages associated with said first cylinder bank and a second integrated member forming a portion of said plurality of primary intake passages associated with said second cylinder bank, an auxiliary air intake system providing a secondary air supply to said combustion chambers, said auxiliary air intake system comprising an inlet and an outlet, said first integrated member and said second integrated member also forming a portion of said auxiliary air intake system and being disposed between said inlet and said outlet such that air flowing from said inlet to said outlet must pass through said first integrated member and said second integrated member, said auxiliary air intake system comprising a first unified supply line that supplies air to said first integrated member and a second unified supply line that supplies air to said second integrated member, and said auxiliary air intake system further comprising a valve that receives air from a third member and controls airflow into said first and second unified supply lines.

37. The outboard motor of claim 36, wherein said third member comprises an inlet that is connected to at least one of said primary intake passages at a location upstream of the corresponding throttle valve.

38. The outboard motor of claim 36, wherein said outlet of said auxiliary air intake system communicates with each of said plurality of primary intake passages at a location downstream of said corresponding throttle valves.

39. The outboard motor of claim 36, wherein said valve of said auxiliary air intake system is disposed atop one of said first integrated member and said second integrated member.

40. The outboard motor of claim 36, wherein said third member communicates with an auxiliary air intake plenum that is disposed rearwardly of said valve.

41. The engine as set forth in claim 17, wherein the unified portion is not connected to any one of the first intake passages through the air inlet.

42. An internal combustion engine comprising an engine body including a cylinder block and a cylinder head defining at least first and second combustion chambers therein, an intake system comprising at least first and second primary induction passage members defining at least portions of first and second induction air passages configured to guide air to the first and second combustion chambers, respectively, at least one valve, configured to meter an amount of air flowing through the primary induction passages, at least one secondary air chamber defined at least in part, by the engine body, and at least first and second secondary induction passages connecting the secondary air chamber to the first and second primary induction passages, at a point downstream of the at least one valve, in the direction of airflow into the engine body.

43. The engine as set forth in claim 42 additionally comprising an intake manifold connected to the engine body and defining portions of the first and second primary induction passages, wherein the secondary air chamber is defined by cooperating portions of the intake manifold and the engine body.

44. The engine as set forth in claim 43, wherein the portion of the engine body is the cylinder head.

45. The engine as set forth in claim 43, wherein the intake manifold further defines portions of the first and second secondary induction passages, the first and second secondary induction passages extending through the intake manifold, generally parallel to the primary induction passages.

46. The engine as set forth in claim 43, in combination with an outboard motor, in which the engine is disposed.

* * * * *